United States Patent [19]

Mausz et al.

[11] Patent Number: 4,471,337

[45] Date of Patent: Sep. 11, 1984

[54] CONDUCTOR BUNDLES FOR THE COILS OF DRY INDUCTORS

[75] Inventors: Johann Mausz; Alfred Wittenhofer, both of Linz, Austria

[73] Assignee: Spezielektra Esslinger K.G., Linz, Austria

[21] Appl. No.: 378,781

[22] Filed: May 17, 1982

[30] Foreign Application Priority Data

Apr. 21, 1982 [AT] Austria ..... 1546/82

[51] Int. Cl.[3] ..... H01F 27/28

[52] U.S. Cl. ..... 336/186; 336/180; 336/187; 336/123

[58] Field of Search ..... 336/186, 187, 223, 180

[56] References Cited

U.S. PATENT DOCUMENTS 2,735,979 2/1956 Coben ..... 336/223 X 4,080,543 3/1978 Takahashi et al. ..... 336/187 X

FOREIGN PATENT DOCUMENTS 1294541 5/1969 Fed. Rep. of Germany .

*Primary Examiner*—J. V. Truhe

*Assistant Examiner*—Susan Steward

*Attorney, Agent, or Firm*—Kurt Kelman

[57] ABSTRACT

Conductor bundles for the concentric coils of a dry inductor having no iron core. The coils define cooling air gaps therebetween, adjacent ones of the coils being electrically connected in parallel and each coil being comprised of turns of a conductor bundle of the same rectangular cross section, the coils having different numbers of said turns. The conductor bundles form the turns of the coils and comprise a plurality of conductors electrically insulated from each other and twisted together, the conductor bundles of all coils are structurally identical with respect to the number and cross-sectional dimension of the conductors, and the rectangular cross sections of the conductor bundles forming respective coils have different cross-sectional dimensions in the axial direction of the respective coil whereby the coils have the same dimension in said axial direction while the number of the turns of the coils differs.

5 Claims, 4 Drawing Figures

31
32
33
35
35
343
34a
344
343
34b
344
341
34c
342
345
343
344
l1
l2
l3
34

34
341
342
345
1
2
3
4
5
6
7

CONDUCTOR BUNDLES FOR THE COILS OF DRY INDUCTORS

BACKGROUND OF THE INVENTION

1. Field of the Invention

This invention relates to an inductor, particularly to a dry inductor having no iron core, which inductor comprises two or more concentric cylindrical coils extending about each other and defining intervening cooling air gaps. The coils are electrically connected in parallel and have numbers of turns which decrease in a radially outward direction.

2. Description of the Prior Art

In such inductors, the total conductor cross-section required is divided into a plurality of individual conductors which are insulated from each other. That design minimizes the eddy current losses of the inductor. Such inductors are used mainly in power engineering as compensating inductors, filter inductors and series-connected inductors.

The basic design of concentric coils which extend about each and are electrically connected in parallel is known from BBC-Nachrichten of July/August 1930 and has been described in German patent publication No. 1,294,541. From these publications it is apparent that the distribution of the current to the coils connected in parallel depends on the numbers of turns of the individual coils and the numbers of turns generally decrease from the innermost coil to the outer one. If all coils had the same number of turns, they would have different inductivities so that the current would not be adequately distributed in practice.

If identical conductors are used in the several coils, the different numbers of turns will result in different axial dimensions of the coils. The axial dimension of a coil will subsequently be referred to as the height of the coil. Owing to the different heights of the coils, the axial voltage gradients at the parallel-connected coils vary and impose electric stresses on the structural elements disposed between adjacent coils.

That disadvantage could be eliminated by the use of conductors having different cross-sectional areas in different coils so that all coils have the same height. But that concept is not economical because the several conductors having different cross-sectional areas are needed in relatively small quantities, regardless of whether stranded conductors, round wires or twisted conductors are used.

The distribution of the total conductor cross-section which is required to a plurality of coils connected in parallel is not sufficient to keep the eddy current losses within economical limits. For this reason, the conductor cross-section of each coil must be divided into a multiplicity of individual wires which are insulated from each other.

In a known design, the concept of using concentric coils which are connected in parallel is extended in that each of these coils is divided into concentric windings having graded numbers of turns. Each of these windings consists of insulated wire and the windings are directly wound one on the other. Owing to the extremely high mutual inductivities, the distribution of current to such parallel-connected windings directly wound one on the other requires that the windings have such numbers of turns that the end turns extend only around part of the periphery of the winding and it is usually necessary to connect the ends of the windings by a current-distributing spider of conductive material to a common terminal. That requirement cannot be met with conventional current-distributing spiders having 6, 8 or even 12 arms and it is difficult to make spiders having a larger number of spider arms. For this reason, an irregular distribution of current to the several windings wound one on the other must be tolerated. As a result, the current density is not homogeneous within each multi-winding coil so that the conductors are not economically utilized and a uniform temperature in each coil cannot be obtained.

It is also known to divide the conductor cross-section of each coil by the use of a twisted conductor consisting of a plurality of insulated rectangular individual conductors. Each of the individual wires of the twisted conductor aasumes different positions relative to the axis of the twisted conductor along the latter so that each individual wire lies in different induction zones of the coil. Nevertheless, all individual conductors are subjected to the same average induction conditions so that the current is uniformly distributed to all individual conductors of the twisted conductor. Besides, the twisted conductor may be composed of individual conductors having different dimensions so that cylindrical coils having different numbers of turns may have the same height. But that concept is also uneconomical because a large number of conductors having different cross-sectional areas are required in relatively small quantities. Besides, the magnetic field in the boundary zones of the coil has a strong radial component, which is transverse to the rectangular individual conductors of the twisted conductor and gives rise to heavy eddy current losses therein so that an economically optimum utilization of the conductors is not possible.

SUMMARY OF THE INVENTION

It is an object of the invention to provide an inductor which is of the kind described first hereinbefore and which can be made at low cost and has coils having substantially the same height.

A further object of the invention is to provide a conductor bundle for use in making an inductor by which the first-mentioned object is accomplished.

The first-mentioned object of the invention is accomplished with conductor bundles for the coils, which are identical in structural composition and total cross-sectional conductor area and which consist of conductors which are electrically insulated from each other and twisted together. The conductor bundles are pressed to have rectangular cross-sections having different dimensions in the axial direction of the coils so that the coils have approximately the same height although their numbers of turns decrease in a radially outward direction.

The use of insulated round individual conductors results in a uniform distribution of the eddy current losses because, regardless of the direction of the magnetic field, the eddy current loss depends on the same dimension of the individual conductor, namely, its diameter.

All coils have the same axial voltage gradient because they have the same height. This is due to the fact that identical conductor bundles are pressed to cross-sections having different axial dimensions. The use of identical conductor bundles in the coils permits an economical manufacture of the inductor.

Before the conductor bundle is pressed, each round individual wire assumes different positions relative to the axis of the bundle along the latter, just as in a twisted conductor, so that each individual wire extends through different induction zones of the inductor and a uniform distribution of current within the conductor bundle is obtained.

That requirement can be met in that the individual conductors of the conductor bundle are stranded or twisted together or their positions are cyclically interchanged. Only minimum electric stresses are imposed by the individual conductors of the conductor bundle on each other and these stresses are due only to asymmetries of the induced voltages. For this reason the insulation required for the individual conductors requires only low electrical strengths but for the pressing operation must have high mechanical strengths.

The conductor bundles may consist of round wires which have a varnish insulation, an insulation formed by powder coating, or a strip or film insulation.

To ensure the required electric strength between adjacent coils and to the outside, the conductor bundle pressed to the desired cross-sectional shape has a covering of insulating material which is permeable and adapted to be impregnated and consists preferably of glass fiber cloth.

The conductor bundle may be provided inside the covering on a side which adjoins the adjacent turn with an insert having a high insulation resistance.

To make an inductor according to the invention, each conductor bundle is pressed to have the required cross-sectional shape and the conductor bundles are then wound in a dry state on a winding mandrel in such a manner that axially extending cooling gaps are maintained between the individual cylindrical coils. For this purpose, strips consisting preferably of glass fiber-reinforced plastic material are placed between adjacent coils. When the inductor has been completely wound and provided with terminals, it may be predried and treated in a vacuum and is then impregnated with insulating synthetic resin to fill the interstices between the individual conductors of each bundle and, when it has been cured in a curing oven, joins adjacent turns of each coil and adjacent coils in a mechanically strong assembly.

BRIEF DESCRIPTION OF THE DRAWING

Further details and advantages of the invention will become apparent from the following description of an illustrative embodiment of the invention with reference to the accompanying drawing, in which.

DESCRIPTION OF THE PREFERRED EMBODIMENT

Figure 1:
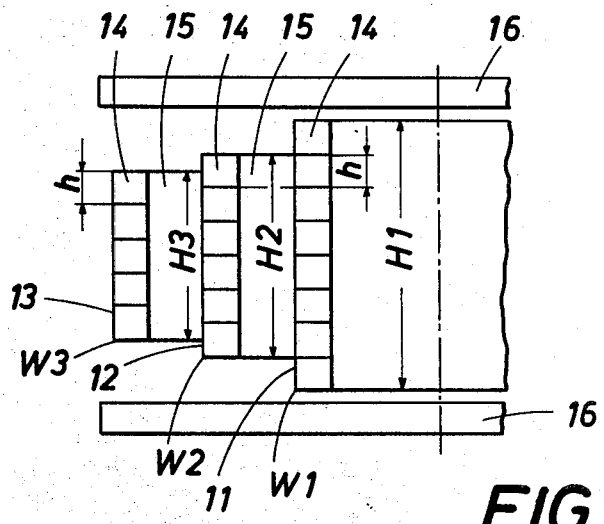
FIG. 1 PRIOR ART
FIG. 1 is a diagrammatic longitudinal sectional view showing the structure of a known inductor.

The known inductor which is diagrammatically shown in FIG. 1 comprises three coils 11, 12 and 13 consisting of conductors 14 of the same cross-section having a height h. Because the numbers of turns W1, W2, W3 of the coils 11, 12, 13 decrease from the inner coil 11 to the outer coil 13, the coils 11, 12, 13 have different heights H1, H2, H3. Cooling gaps 15 are defined between the coils 11, 12, 13 held between clamping end members 16, which may constitute current-distributing spiders, if desired.

Figure 2:
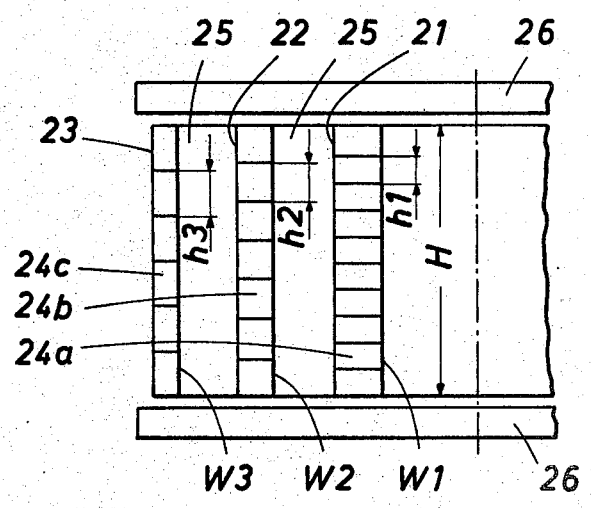
FIG. 2 is a view which is similar to FIG. 1 and shows an inductor embodying the invention.

An inductor which embodies the invention is shown in FIG. 2 and comprises three coils 21, 22, 23 having the same height H although the numbers of turns W1, W2, W3 of the coils decrease from the inner coil 21 to the outer coil 23. This is accomplished by the fact that the coils 21, 22, 23 consist of conductor bundles *24a*, *24b*, *24c*, respectively, which have been pressed to have different cross-sectional heights h1, h2, h3, which vary inversely to the numbers of turns W1, W2, W3 of the coils. Cooling gaps 25 are defined between adjacent coils. The coil array is held between clamping end members 26, which may constitute current-distributing spiders, if desired.

Figure 3:
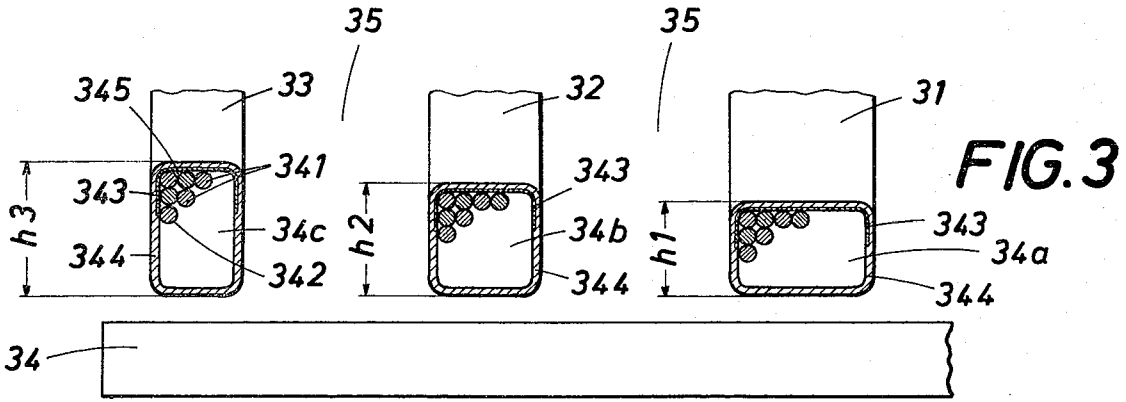
FIG. 3 is an enlarged sectional view showing individual coils of an inductor embodying the invention and FIG. 4 consists of a side elevation and a plurality of sectional views showing a conductor bundle which can be used to form the coils.
Figure 4:
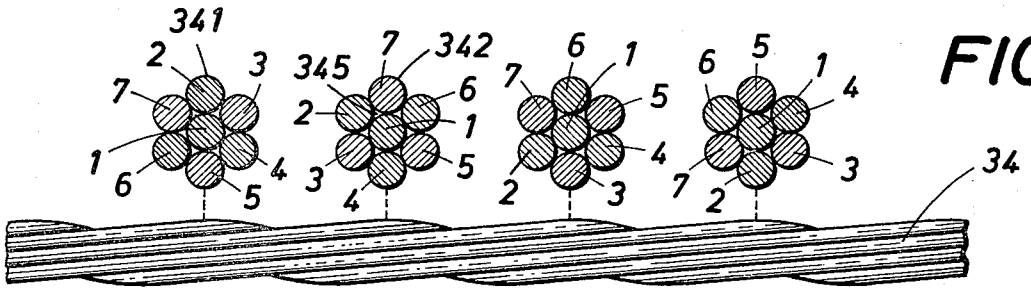

FIG. 3 is a sectional view showing an inductor according to the invention. FIG. 4 illustrates the structure of the conductor bundle from which the coils are made and how it is pressed to a rectangular cross-sectional shape.

In FIGS. 3 and 4, the coils of the inductor embodying the invention are designated 31, 32, 33. Only the lower end of each coil 31, 32, 33 in contact with the clamping end member 36 is shown. All three coils 31, 32, 33 have been made from identical conductor bundles 34, which have been pressed to assume different cross-sectional shapes *34a*, *34b*, *34c* and have different cross-sectional heights h1, h2, h3.

FIG. 4 is a simplified representation of the conductor bundle 34 in its initial shape. It consists of a plurality of round individual conductors 341, each of which has an insulation 342 and which are arranged in the conductor bundle at positions 1, 2, 3, 4, 5, 6, 7. It is apparent that the individual conductors 1 to 7 have been stranded or twisted or their positions have been cyclically interchanged so that the position of each individual conductor relative to the axis of the conductor bundle is continuously or continually changed.

Each of the pressed conductor bundles *34a*, *34b*, *34c* (FIG. 3) is provided with a covering 344 consisting of glass fiber cloth or another insulating material which is permeable to liquid impregnating material. The assembly consisting of the coils *34a*, *34b*, *34c* provided with the coverings 344 is impregnated with a thermosettable insulating synthetic resin, which fills the interstices 345 between the round individual conductors of each bundle and when it has been cured joins adjacent turns of each coil and joins adjacent coils to the structural elements which maintain the cooling gaps 35. The electric strength between the turns of each coil is increased by an insert 343, which has a high insulation resistance and is disposed inside the covering 344 on that side of the conductor bundle which adjoins the adjacent turn.

What is claimed is:

1. A dry inductor having no iron core and comprising a plurality of concentric coils extending about each other and defining cooling air gaps therebetween, adjacent ones of the coils being electrically connected in parallel and each coil being comprised of turns of a conductor bundle of the same rectangular cross section, the coils having different numbers of said turns, wherein the conductor bundles forming the turns of the coils comprise a plurality of conductors electrically insulated from each other and twisted together, the conductor bundles of all of said coils are structurally identical with respect to the number and cross-sectional dimension of the conductors, and the rectangular cross sections of the conductor bundles forming respective ones of said coils have different cross-sectional dimensions in the axial direction of the respective coil whereby the coils have the same dimension in said axial direction while the number of the turns of the coils differs.

2. The dry inductor of claim 1, comprising three of said coils.

3. The dry inductor of claim 1, wherein each conductor bundles comprise at least three of said conductors twisted together so that the position of each of said conductors relative to the axis of the bundle continually changes along the bundle.

4. The dry inductor of claim 3, wherein the positions of said conductors are cyclically interchanged along the bundle.

5. The dry inductor of claim 4, further comprising an insulating material covering surrounding each conductor bundle, the covering having interstices and the twisted conductors defining interstices therebetween, structural elements disposed between adjacent ones of the coils to space them apart in a radial direction, and an impregnating thermoset insulating synthetic resin filling the interstices, the synthetic resin filling joining adjacent turns of the coils and joining the coils to the structural elements in a mechanically strong assembly.

* * * * *